US005261191A

United States Patent [19]

Wick

[11] Patent Number: 5,261,191

[45] Date of Patent: Nov. 16, 1993

[54] METHOD OF SURFACE PREPARATION

[75] Inventor: Walter T. Wick, Utica, Mich.

[73] Assignee: Waltom Services, Inc., Pontiac, Mich.

[21] Appl. No.: 663,323

[22] Filed: Mar. 1, 1991

[30] Foreign Application Priority Data

Sep. 15, 1990 [GB] United Kingdom ..... 9020204

[51] Int. Cl.[5] ..... B24C 1/00

[52] U.S. Cl. ..... 51/320; 51/319; 51/317

[58] Field of Search ..... 51/281 R, 317, 318, 51/319, 320, 410, 424, 427, 428, 431, 432

[56] References Cited

U.S. PATENT DOCUMENTS

| | | | |
|---|---|---|---|
| 3,939,613 | 2/1976 | Ayers . | |
| 4,044,507 | 8/1977 | Cox et al. | 51/427 |
| 4,249,956 | 2/1981 | Hartman | 51/427 |
| 4,731,125 | 3/1988 | Carr . | |
| 4,753,094 | 6/1988 | Spears | 51/320 |
| 4,773,189 | 9/1988 | MacMillan | 51/410 |
| 4,877,638 | 11/1989 | Novak | 51/320 |
| 4,943,368 | 7/1990 | Gilbert et al. | 51/319 |
| 5,024,711 | 6/1991 | Gasser et al. | 51/320 |
| 5,063,015 | 11/1991 | Lloyd et al. | 51/320 |
| 5,092,084 | 3/1992 | Schlick | 51/410 |

FOREIGN PATENT DOCUMENTS 1397102 3/1972 United Kingdom .

OTHER PUBLICATIONS

European Patents Report-P55-EP-332-886-A—Bloch.

*Primary Examiner*—Bruce M. Kisliuk
*Assistant Examiner*—Bo Bounkong
*Attorney, Agent, or Firm*—Harness, Dickey & Pierce

[57] ABSTRACT

A method is described for altering the surface of a virgin plastic moulding by impingement of plastic particles to render the surface suitable for the application of a coating. The coating will adhere and resist peeling better than with previous chemical surface preparation techniques. The method of the present invention calls for the use of graded granular plastic media material having a Barcol hardness between 20 and 80, propelled by compressed air or liquids or by mechanical means. The plastic media is totally recyclable such that by-products can be used in recycled markets.

19 Claims, 1 Drawing Sheet

METHOD OF SURFACE PREPARATION

BACKGROUND OF THE INVENTION

The present invention relates generally to a method for treating the surface of plastic substrates and, more particularly, to a plastic media blast system adapted to improve the adhesion characteristics of the plastic substrate surface upon substrate application of a coating thereon.

With respect to the recent growth in automotive, aerospace, and aeronautical applications using advanced plastics and composite substrates, a related area of concern involves the ability to apply one or more layers of a protective and/or cosmetic coating thereon. More particularly, for various plastics materials, it is often difficult to achieve acceptable adhesion of the coating because of the non-profiled, smooth or otherwise slick surface properties typically associated with such materials. As such, poor coating adhesion results in an excessively high rate of product "rejects" being produced following the coating process, as well as increased incidences of product warranty claims, both of which result in significant rework or scrap costs to the manufacturing concern.

Conventionally, various chemical techniques are used for improving the adhesion characteristics of plastic substrates, such as the application of etchants, saline solutions or the application of an intermediate surface activation coating. In addition, adhesion promoters, as components of the coating material, are sometimes used as is flame heat treatment of the plastic substrate surface to be coated. However, with the advent of more stringent regulatory policies governing the transport and disposal of toxic chemical solutions, waste and the like, a greater emphasis is now being placed on development and utilization of non-chemical surface treatment methods.

Several non-chemical surface preparation methods, such as sand or grit blasting, are used for cleaning the surface of metal substrates before painting. Unfortunately, these techniques are not suitable for substrates made from plastic or a reinforced composite material since such abrasive blasting causes excessive damage to the surface. For example, with glass-fiber reinforced plastics, a surface preparation technique should not penetrate through the plastic to the underlying fibers. In the case of objects moulded of a plastic material, the outermost surface layers are typically harder and less porous than the underlying material. Under both scenarios, any excessive damage caused to the outermost layers during pre-coat surface treatment, may allow the coating to soak into the underlying material and give a non-uniform appearance.

SUMMARY OF THE INVENTION

Accordingly, the present invention is directed to a method for "treating" or "preparing" the exterior surface of a plastic substrate for enhancing its coating adhesion characteristics while overcoming the disadvantages associated with the prior art processes. More particularly, the improved surface preparation method of the present invention is a plastic media blasting process for propelling and impacting recyclable plastic particles against the substrate surface at a preselected velocity and angle whereby the surface profile is slightly altered for causing a corresponding improvement in the adhesion of a subsequently applied coating.

The surface preparation method of the present invention has been proven by testing and analysis to improve the adhesion of a paint film compared to a paint film applied to a virgin substrate surface, while causing no discernable detriment to the texture, contour or features lines of the blasted surface. Moreover, the coated surface of the plastic substrate component will also have improved resistance to peeling upon impact or abrasion. In general, the method of the present invention is adapted for use with any plastic component forming part of an automobile (i.e. body panels, bumpers, door mirrors, etc.) aerospace parts, domestic appliances, or any plastic moulding to which a decorative or protective finish is to be applied.

The recyclable plastic media may be made from various materials such as a thermosetting plastic (i.e. urea fomaldehyde), a polycarbonate, or of polyester, as these materials have a sufficiently low hardness and can be obtained in a sharp-edged, granular particulate form. Preferably, the hardness of the media blast particles should be between 20 and 80 Barcol hardness, which corresponds at least approximately to Moh hardness values between about 2.0 and 4.0, so as to be slightly harder than the plastic substrate. Moreover, the particles are preferably graded, into a limited range of sizes for example 150 to 180 microns (US sieve size 80–100), 600 to 850 microns (US sieve size 20–30), or 1180 to 1700 microns (US sieve size 12–16).

The plastic media blast system of the present invention includes a propulsion device for propelling the particles and which may comprise pneumatic, hydraulic, or mechanical means. The particles are directed at the surface of the plastic substrate material at any angle of incidence between 0 and 90 degrees, although an angle of incidence between 30 and 60 degrees is preferred. Either the propulsion device, the plastic material or both may be moved during the processing to affect the rate of surface profile alteration and the desired characteristics thereof. Additionally, the heat of friction and/or the cooling effect of the propulsion method is considered to be a control variable which can affect the results achieved.

Since the plastic abrasive media will have a predictable life attributable to impact-related breakdown, the particles may be continually recirculated, with the fine particles being removed from the system by passing through a separator device. Moreover, the non-hazardous by-product of the surface treatment method, composed of the separated fine plastic particles, can be used in a recycled market (i.e. plastic lumber, concrete filter, etc.).

According to a further object, the present invention also provides a method for coating a surface of a plastic substrate, the method comprising preparing the surface in the manner specified above so as to provide an altered surface having enhanced adhesion characteristics, and then applying the coating to the surface.

In a final related object, the surface preparation method of the present invention permits increased utilization by automotive, industrial, and aeronautical manufacturers of plastic materials, herebefore considered impractical due to poor adhesion and coatability characteristics, for decorative and/or protective coated component applications. In addition, due to the low pressure and mass-flow characteristics of this plastic media blast surface preparation process, the present invention is superior to conventional abrasive blasting methods utilizing significantly higher nozzle pressures.

BRIEF DESCRIPTION OF THE DRAWINGS

Further objects, features and advantages of the present invention will be apparent from the following description and accompanying drawings in which.

DETAIL DESCRIPTION OF PREFERRED EMBODIMENTS

In general, the present invention is directed to a plastic media blasting (PMB) method using a recyclable plastic media for altering the surface profile characteristics of an organic material so as to substantially improve the adhesion characteristics of a coating subsequently applied thereto. More particularly, the present invention is directed to the use of plastic media blasting as a surface preparation process for virgin surfaces and not a cleaning process for removal of adherent layers. As such, the present invention is particularly well-suited for use with objects moulded from virtually any organic (i.e. plastic, elastomeric, reinforced composites etc.) substrate material. As is known, despite the advantageous strength and lightweight characteristics of the above-identified organic materials, such materials typically have a relatively soft surface hardness compared to conventional metallic substrates. However, the method of the present invention is intended to overcome the conventional beliefs of the plastics industry wherein it had been considered impractical to use any type of media blast processing for preparing a plastic substrate surface to receive a coating due to the expectation of excessive surface abrasion or damage. Finally, it is to be understood that the term coating is a generic term of art for the application of a relatively thin layer or film of organic material and which encompasses "paints" and the like.

Figure 1:
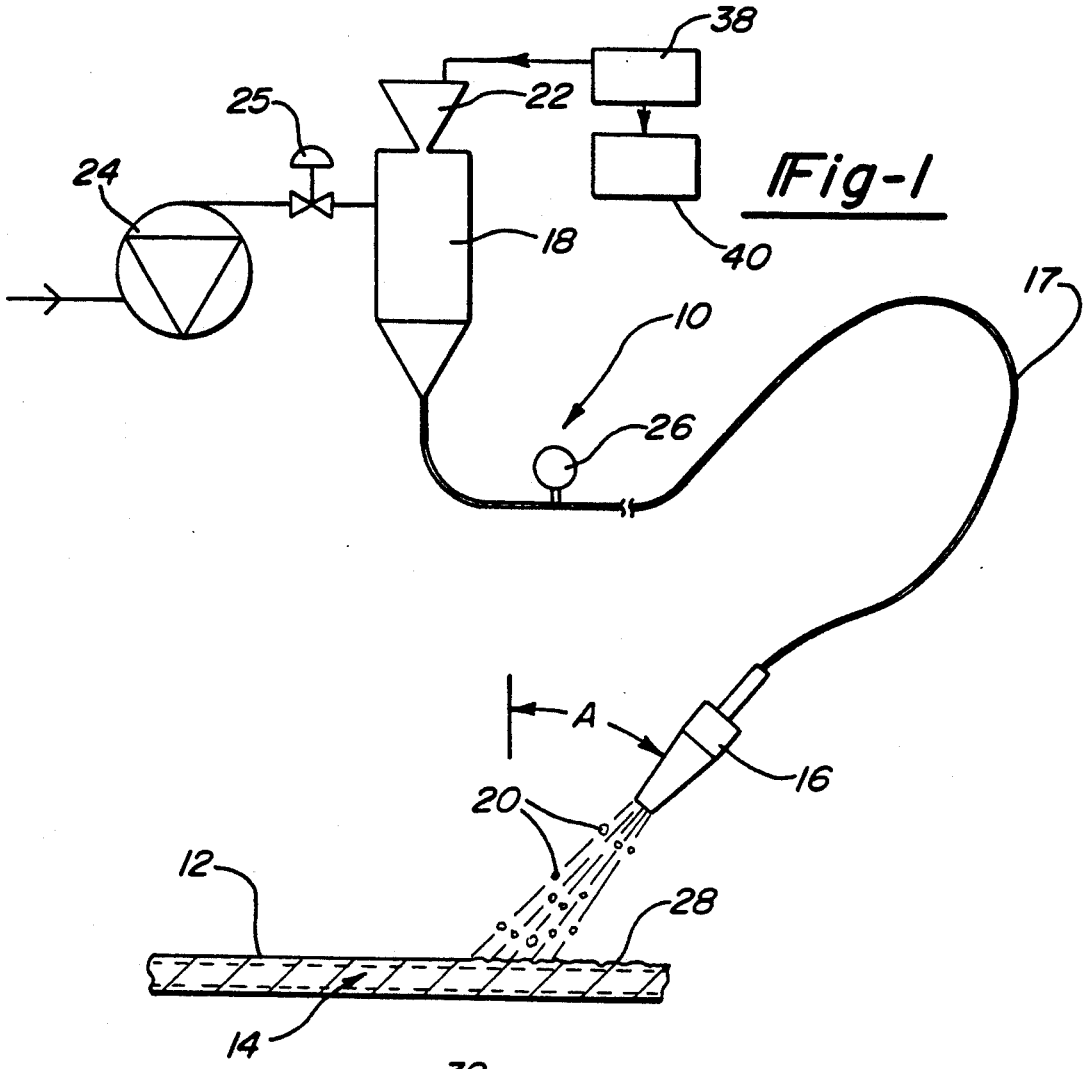
FIG. 1 is a diagrammatic sectional view of equipment associated with the plastic media blast system of the present invention which is used for altering the surface profile of an organic substrate to which a coating is to be subsequently applied.

Referring to FIG. 1, an apparatus 10 is shown for selectively altering the surface characteristics of a virgin surface 12 of a moulded organic (i.e. plastic, elastomeric, composite etc.) object or component 14 to which one or more layers of a suitable coating is subsequently to be applied. It is to be understood that the term "altering" is being used hereinafter to describe the process of deliberately cold working surface 12 for modifying the surface profile thereof and which includes, but is not limited to the texturing, abrading, and scuffing of virgin surface 12. In addition, surface "alteration" may also be due to the heat of friction, caused upon impact of the plastic media particles on virgin surface 12. Moreover, such modification to the surface profile may or may not be visually discernable upon visual inspection following the media blasting operation. As will be described hereafter in greater detail, the specific degree of surface alteration is dependent on several factors including the hardness of the plastic substrate and media, the velocity and angle of incidence of the propelled media, the impact force imparted by the propelled media, the duration of impingement, and the desired surface finish of the "as coated" surface.

In general, apparatus 10 is a plastic media blast system having a discharge device, shown as blasting nozzle 16, that is similar to nozzles used for abrasive (i.e. sand) blasting, and which is connected by a flexible conduct or tube 17 to a pressurized vessel 18. Vessel 18 is supplied with a mixture of plastic media particles 20 from a hopper 22. The mixture is preferably of a graded, limited range of sized particles categorized by standardized U.S. seive sizes. Furthermore, vessel 18 is also supplied with compressed air from a supply line 24 having an adjustable pressure regulator or control valve 25 so that particles 20 are pneumatically propelled out of nozzle 16 to impact and impinge surface 12. A pressure gauge 26 enables the pressure at nozzle 16 to be monitored, and this pressure can be controllably varied by selective adjustment of valve 25. In this manner, a relatively continuous flow of particles 20 in a mixture of pressurized air will be expelled from nozzle 16 at a relatively low pressure with a relatively high mass-flow rate. In operation, nozzle 16 is scanned relative to surface 12 at a predetermined angle of incidence "A" and for a predetermined duration until the entire profile of surface 12 has been altered (as indicated in an extremely exaggerated manner at 28).

Before use of apparatus 10 it is necessary to determine, for example by experiments on moulded specimens of the same material as component 14; the optimum material, size, and shape of plastic media particles 20, and the optimum particle velocity (which is selectively controlled by adjustment of the pneumatic pressure at nozzle 16), the angle of incidence "A", the scanning speed, the distance between nozzle 16 and surface 12, and the duration of treatment. These parameters are all dependent on the substrate material from which component 14 is moulded and on the extent of surface alteration desired to provide substantially enhanced adhesion of a subsequently applied paint layer.

Preferably, the media mixture is composed of granular particles 20 of polycarbonate, urea formaldehyde, polyester or the like, ranging in hardness from 20 Barcol hardness to 80 Barcol hardness, (i.e. approximately 2.0 to 4.0 Mohs hardness). A suitable commercially available plastic media which can be used with the present invention is plastigrit (trademark) distributed by Composition Materials Company, Inc. As wil be appreciated, the overall hardness of the media is generally slightly greater than the hardness of virgin surface 12 for causing the desired surface alteration upon impact therebetween.

With nozzle 16 held at a predetermined "target" distance from virgin surface 12, pneumatic pressures at nozzle 16 of between about 33 kPa (5 psi) and 200 kPa (30 psi) have been found suitable for sufficiently altering the surface profile of a wide range of plastics material including ABS polymers, polypropylene, polycarbonate, polyamide, blended plastics, and SMC (reinforced) plastics. Moreover, it has been determined that pressures in excess of 200 kPa (30 psi) generally tend to cause excessive damage to surface 12 which detrimentally effects the visual appearance, texture and gloss of the "treated" surface. However, it will be appreciated that an increase in the "target" distance between nozzle 16 and surface 12 permits a proportional increase in nozzle pressure for creating similar impact characteristics at surface 12. Furthermore, the scanning area and velocity characteristics may be modified by use of different sized nozzles 16 (i.e. diameters ranging between 4.5 mm and 25 mm) depending on the size and shape of component 14.

The surface preparation method of the present invention is intended to be an integral part of the overall coating process for plastic substrates, by providing essential pretreatment of surface 12. After virgin surface 12 has been altered, it is coated with a suitable paint, topcoat or the like by a conventional painting or coating technique. If desired, chemical adhesion promoters may also be used prior to application of the paint or coating.

Figure 2:
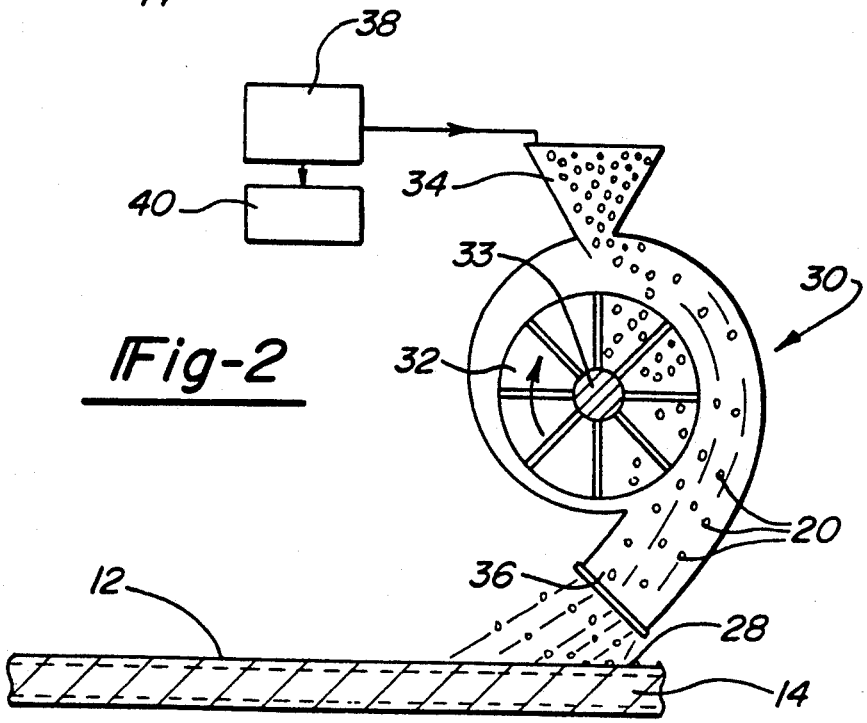
FIG. 2 is a diagrammatic sectional view of an alternative system for preparing the surface of the object.

It will be appreciated that other means may be used to propel media particles 20 for impacting and impinging surface 12. For example, a liquid propellant may be used instead of compressed air, as long as substantially the same particle velocity is achieved. Referring to FIG. 2, an alternative PMB equipment system 30 is shown, with which substantially the same surface alteration process can be achieved. Blast system 30 uses a wheeled impeller 32, mechanically driven by shaft 33 via a power source (not shown) to propel particles 20 at the desired discharge velocity. Moreover, the power source can be selectively controlled for varying the RPM of wheeled impeller 32 and, in turn, producing a corresponding change in the discharge velocity of particles 20. Particles 20 are supplied to impeller 32 from a hopper 34 and are propelled through a nozzle-like outlet 36 to impact and impinge surface 12 of moulded plastics component 14. As will be appreciated, a flexible tube can be interconnected between outlet 36 and a nozzle in a fashion similar to that shown in FIG. 1 for providing added flexibility to system 30.

In operation of the method, whichever equipment may be used, it is found that particles 20 degrade relatively slowly. The spent particles 20 may be recovered either automatically through a collecting hopper or swept up or vacuumed manually. In both cases, a majority of the spent particles 20 are returned to hopper (22 or 34) via a separator device 38 such as a cyclone, which passes to waste bags 40 the finer grade, unusable broken particles. Thereafter, the recycled non-hazardous broken particles can be re-used for various other applications such as a filler component for concrete, plastic lumber and the like. As such, the present invention is a totally recyclable non-chemical surface preparation process. Furthermore, in each case nozzle (16 or 36) may be hand held or attached to an automatic machine which moves it over surface 12 following the specific contours of component 14. In some semi-automated or automated systems, component 14 may be moved in concert with nozzle 16 or 36 which may either be moving or fixed.

The above described process for altering the surface profile of virgin plastic mouldings has been found to provide better adhesion for decorative finishes such as paints, than the chemical and flame treatments currently practiced. Moreover, when desired, the texture of the modified surface 28 can be assessed visually, under magnification, and a uniform desired texture can be reliably achieved.

What is claimed is:

1. A method for enhancing adhesion characteristics on a plastic substrate upon subsequent application of a coating thereto, said method comprising the steps of:

providing a plastic substrate having a smooth or otherwise slick surface;

providing a mixture of plastic granular particles having a hardness that is slightly greater than the hardness of said plastic substrate surface;

abrading the exterior surface of said surface by propelling said particle mixture in a relatively continuous flow for impacting and impinging said surface of said plastic substrate so as to rough said surface whereby the adhesion characteristics of said surface are enhanced; and enabling a coating to be adhered to said plastic substrate surface.

2. The method of claim 1 wherein said plastic particle mixture is made from a recyclable plastic media material having a Barcol hardness ranging between 20 and 80 for deforming said surface upon impingement of said particles therewith.

3. The method of claim 2 wherein said propelling step includes directing said plastic media at a preselected angle of incidence relative to said surface, and wherein said plastic media is propelled at a preselected velocity which can be selectively controlled to cause a corresponding change in degree of surface alteration generated.

4. The method of claim 3 wherein said propelling step comprises providing means for propelling said plastic media mixture at said preselected velocity for blasting said surface with a substantially continuous high-mass flow of said particles.

5. The method of claim 4 wherein said propelling means is a pneumatic propulsion apparatus provided for causing said plastic media mixture to flow at a discharge pressure ranging between about five to thirty-five pounds per square inch at a nozzle outlet.

6. A method of claim 4 further comprising the steps of:

collecting spent particle mixture following impingement on said surface;

separating said spent particle mixture by predetermined size classifications;

returning a reusable portion of said particle mixture to said propelling means for continuous blasting on said plastic substrate surface; and recycling a non-useable portion of said particle mixture such that said particle mixture used with said method is substantially totally recyclable.

7. A method of claim 6 further comprising the step of applying a coating on said surface of said plastic substrate following selective alteration of said surface.

8. The method of claim 4 wherein at least one of said nozzle outlet and said plastic substrate are moveable relative to the other for scanning said plastic media over said surface for a preselected duration so as to selectively alter the surface profile thereof without causing discernable damage to contour of said plastic substrate surface.

9. A method of claim 8 further including the step of maintaining said surface stationary while moving said nozzle to direct said plastic media mixture in a varying manner over said surface.

10. A method of treating a surface of a component made from an organic material prior to applying a coating thereto, said method comprising the steps of:

providing an organic material component having a smooth or otherwise slick surface;

providing a mixture of granular organic particles having a hardness that is slightly greater than the hardness of said component surface;

impinging said component surface with said organic particles;

abrading the exterior surface of said component surface by propelling said particle mixture in a relatively continuous flow toward said component surface so as to rough said surface whereby the adhesion characteristics of said surface are enhanced;

enabling a coating to be adhered to said roughed component surface; and reclaiming the by-products of said particle mixture for recycled use as a composite filler material, whereby said method is a media blasting process which is substantially recyclable.

11. The method of claim 10 wherein said granular particle mixture is made from a recyclable plastic media having a Barcol hardness ranging between about 20 and 80 being selected for causing deformation to said surface upon impingement of said particles thereon.

12. The method of claim 11 wherein said propelling step includes directing said plastic media mixture at a preselected angle of incidence relative to said surface with said plastic media mixture being propelled at a preselected velocity for a predetermined duration.

13. The method of claim 12 wherein said propelling step comprises providing means for propelling said plastic media mixture at said preselected velocity for blasting said surface with a substantially continuous high-mass flow of said plastic particles.

14. The method of claim 13 wherein said propelling means is adapted to cause said media mixture to be discharged at a pressure from about five to thirty-five pounds per square inch from a nozzle outlet, said discharge pressure being selectively variable for causing a corresponding change in the degree of surface alteration generated.

15. The method of claim 14 further comprising the step of applying a coating to said surface subsequent to said blasting of said surface.

16. The method of claim 14 wherein at least one of said nozzle outlet and said component are moveable relative to the other for directing said media flow over said surface for a preselected duration so as to selectively alter the surface profile thereof.

17. A method of claim 16 including the step of maintaining said surface stationary while moving said nozzle outlet to direct said media flow in a varying manner over said surface.

18. A method of claim 16 wherein said propelling means includes pressurizing said media means with pneumatic pressure.

19. A method of claim 16 wherein said organic material is a plastic, elastomeric or composite polymeric substrate with a surface layer having a Barcol hardness at least equal to or less than the Barcol hardness of said plastic particles.

* * * * *